US006424084B1

(12) United States Patent
Kimiya et al.

(10) Patent No.: US 6,424,084 B1
(45) Date of Patent: Jul. 23, 2002

(54) CATHODE RAY TUBE APPARATUS INCLUDING AN ELECTRON GUN ASSEMBLY CAPABLE OF DYNAMIC ASTIGMATISM COMPENSATION

(75) Inventors: Junichi Kimiya; Takashi Awano, both of Fukaya; Shigeru Sugawara, Saitama-ken, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/175,462

(22) Filed: Oct. 20, 1998

(30) Foreign Application Priority Data

Oct. 20, 1997 (JP) ..... 9-286929
Oct. 21, 1997 (JP) ..... 9-288654

(51) Int. Cl.[7] ..... H01J 29/50; H01J 29/46; H01J 29/56; H01J 29/58; G09G 1/04

(52) U.S. Cl. ..... 313/414; 313/412; 313/449; 315/15; 315/382; 315/382.1; 315/368.27

(58) Field of Search ..... 313/409, 413, 313/414, 415, 421, 425, 429, 426–27, 432–33, 434, 437, 440–41, 444, 448–49, 452; 315/14–16, 382, 395, 364, 382.1, 368.27, 169.1, 169.3, 411

(56) References Cited

U.S. PATENT DOCUMENTS 4,704,565 A * 11/1987 Blacker, Jr. et al. .... 313/412 X
4,712,043 A 12/1987 Takenaka et al. ..... 313/414 X
5,677,591 A 10/1997 Toujou et al. ..... 313/414
6,031,346 A 2/2000 Shirai et al. ..... 313/414 X

FOREIGN PATENT DOCUMENTS

JP 57-15463 3/1982

* cited by examiner

*Primary Examiner*—Vip Patel
*Assistant Examiner*—Mack Haynes
(74) *Attorney, Agent, or Firm*—Pillsbury Winthrop LLP

(57) ABSTRACT

In the electron gun assembly of a cathode ray tube, a main electron lens portion is formed by a fifth grid to an eighth grid, and incorporates a quadrupole lens. The fifth grid receives a voltage obtained by superposing, on a voltage as a reference voltage, a dynamic voltage that parabolically changes with an increase when the electron beam is deflected amount of the electron beam. The sixth grid receives a voltage obtained by superposing, on a voltage as a reference voltage, a dynamic voltage that parabolically changes with an increase when the electron beam is deflected amount of the electron beam. The seventh grid receives the voltage, while the eighth grid receives an anode voltage.

15 Claims, 10 Drawing Sheets

CATHODE RAY TUBE APPARATUS INCLUDING AN ELECTRON GUN ASSEMBLY CAPABLE OF DYNAMIC ASTIGMATISM COMPENSATION

BACKGROUND OF THE INVENTION

The present invention relates to a cathode ray tube applied to a color picture tube and the like and, more particularly, to a cathode ray tube including an electron gun assembly capable of dynamic astigmatism compensation.

A self-convergence in-line color picture tube comprises an in-line electron gun assembly for emitting three electron beams in line, i.e., a center beam and a pair of side beams passing through the same horizontal plane, and a deflection yoke for forming a nonuniform magnetic field for deflecting the electron beams emitted by the electron gun assembly. The three electron beams emitted by the electron gun assembly converge on the center of the screen by the action of a main lens portion included in the electron gun assembly, and at the same time self-converge on the entire screen due to a nonuniform magnetic field made up of a pincushion horizontal deflecting magnetic field and a barrel vertical deflecting magnetic field.

As shown in FIG. 1A, electron beams 6 passing through the nonuniform magnetic field are influenced by astigmatism, e.g., forces in the directions of arrows 11H and 11V by a pincushion magnetic field 10. A beam spot 12 formed on a phosphor screen by the electron beams 6 landing on the peripheral portion of the phosphor screen is distorted as shown in FIG. 1B. This distortion is caused by a deflection aberration or excessive focus of the electron beams 6 in the vertical, i.e., V axis direction.

As a result, the beam spot 12 forms a halo 13A widening in the vertical direction and a core 13B extending in the horizontal, i.e., H axis direction. This deflection aberration becomes more conspicuous as the tube size is larger or the deflection angle of the tube is wider, resulting in a very low resolution at the peripheral portion of the phosphor screen.

Examples of a means for solving a decrease in resolution due to the deflection aberration are disclosed in Jpn. Pat. Appln. KOKAI Publication Nos. 61-99249, 61-250934, and 2-72546. Each of these electron gun assemblies basically has a cathode K, and first to fifth grids G1 to G5, as shown in FIG. 2A. The electron gun assembly has an electron beam generating portion GE, a quadrupole lens portion QL, and a final focusing lens portion EL sequentially arranged along the direction in which the electron beam travels.

The third grid G3 forming the quadrupole lens portion QL has three rectangular electron beam passage holes 14*a*, 14*b*, and 14*c* in a surface facing the fourth grid G4, as shown in FIG. 2B. The fourth grid G4 has three rectangular electron beam passage holes 15*a*, 15*b*, and 15*c* in a surface facing the third grid G3, as shown in FIG. 2C. The electron beam passage hole 14 (*a, b, c*) is formed with a shape asymmetrical to the electron beam passage hole 15 (*a, b, c*).

In the electron gun assembly, the lens powers of the quadrupole lens portion QL and the final focusing lens portion EL change in accordance with the beam deflection amount of the electron beam to compensate for the influence of any deflection aberration produced by the deflecting magnetic field on the electron beam deflected to the screen periphery, and to correct distortion of the beam spot on the phosphor screen.

Even with this correction means, however, when the electron beam is deflected toward the peripheral portion of the screen, generation of a halo of the beam spot can be suppressed, but vertically collapsing distortion of the beam spot cannot be satisfactorily corrected.

FIG. 3 is a view for explaining the electron beam orbit and the lens operation in the electron gun assembly shown in FIG. 2A. In FIG. 3, the solid lines represent the electron beam orbit and the lens operation when electron beams are not deflected and focus on the center of the screen. The broken lines represent the electron beam orbit and the lens operation when electron beams are deflected and focus on the peripheral portion of the screen.

As shown in FIG. 3, when electron beams are not deflected, the electron beams focus on the center of the phosphor screen by the action of only the main electron lens portion EL indicated by the solid lines. When electron beams are deflected, electron beams focus on the peripheral portion of the phosphor screen by the action of the quadrupole lens portion QL located on the cathode side of the main electron lens portion EL, the main electron lens portion EL, and a deflection yoke lens portion DYL, i.e., a deflection aberration component included in the deflecting magnetic field formed by a deflection yoke.

Since a color cathode ray tube generally has a self-convergence deflecting magnetic field, a focusing lens is formed in only the vertical direction V while the focusing force in the horizontal direction H remains unchanged. In FIG. 3, therefore, the lens action of the deflecting magnetic field in the horizontal direction H is not illustrated.

When electron beams are deflected, the lens power of the main electron lens portion EL weakens as indicated by the broken lines, and the quadrupole lens portion QL is formed as indicated by the broken lines so as to compensate the focusing action in the horizontal direction H. Consequently, electron beams pass through electron beam orbits indicated by the broken lines in FIG. 3 to focus on the peripheral portion of the screen.

In the example of FIG. 3, when electron beams are focused on the phosphor screen, the principal plane of the lens, i.e., virtual lens center (cross point between the orbit of a beam emitted by the cathode and the orbit of a beam incident on the phosphor screen) is at position A when the electron beam is not deflected. To the contrary, when the electron beam is deflected, the principal plane of the lens in the horizontal direction H moves from position A to position B on an accordance with generation of the quadrupole lens portion QL. At this time, the principal plane of the lens in the vertical direction V moves from position A to position C on the phosphor screen side.

The principal plane in the horizontal direction H therefore moves back from position A to position B on the cathode side to increase the lens magnification. This increases the beam spot diameter on the phosphor screen in the horizontal direction. The principal plane in the vertical direction V moves forward from position A to position C on the phosphor screen side to decrease the lens magnification. This decreases the beam spot diameter on the phosphor screen in the vertical direction. As a result, the magnification becomes different between the horizontal and vertical directions, and a beam spot formed by the electron beam landing on the peripheral portion of the screen is elongated in the horizontal direction H.

BRIEF SUMMARY OF THE INVENTION

The present invention has been made to solve the above problems, and has as its object to provide a cathode ray tube capable of obtaining a high image quality over the entire screen by preventing distortion of the spot formed by the electron beam resulting from the difference in lens magnification between the horizontal and vertical directions when electron beams are focused on the peripheral portion of the screen.

According to the present invention, there is provided a cathode ray tube comprising:

an electron gun assembly having an electron beam forming portion for forming and emitting at least one electron beam and a main electron lens portion for accelerating and focusing the electron beam; and a deflection yoke for generating a deflecting magnetic field for deflecting the electron beam emitted by the electron gun assembly and scanning a screen in vertical and horizontal directions, the main electron lens portion having first, second, and third lens regions sequentially formed by a voltage distribution continuously increasing along a traveling direction of the electron beam, the second lens region having means for, assuming that horizontal and vertical directions be perpendicular to the traveling direction of a nondeflected electron beam traveling toward a center of a screen, forming an asymmetrical lens having a focusing force in the vertical direction relatively different from a focusing force in the horizontal direction.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of a cathode ray tube according to the present invention will be described in detail below with reference to the several views of the accompanying drawing.

Figure 4:
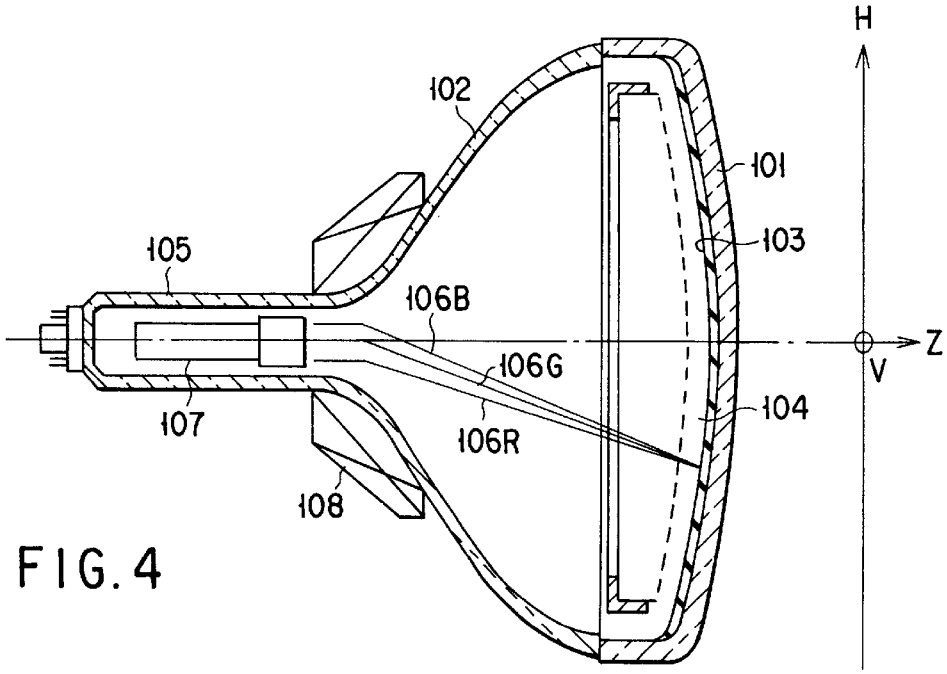
FIG. 4 is a cross-sectional view showing the schematic structure of a self-convergence in-line color picture tube as an example of a cathode ray tube according to the present invention.

As shown in FIG. 4, a self-convergence in-line color picture tube as an example of the cathode ray tube of the present invention has an envelope constructed by a panel 101 and a funnel 102 integrally joined to the panel 101. The inner surface of the panel 101 is coated with a phosphor screen 103 (target) made of three color phosphor layers in a stripe or dot shape for emitting blue, green, and red beams. The panel 101 incorporates a shadow mask 104 having many apertures and facing the phosphor screen 103.

The funnel 102 comprises an in-line electron gun assembly 107 which is located inside a neck 105 and emits three electron beams 106B, 106G, and 106R in line, i.e., a center beam 106G and a pair of side beams 106B and 106R passing through the same horizontal plane. A deflection yoke 108 for forming a nonuniform magnetic field is mounted outside the funnel 102. The nonuniform magnetic field is made up of a pincushion horizontal deflecting magnetic field formed in the horizontal, i.e., H axis direction perpendicular to the traveling direction of the electron beam, i.e., Z axis direction, and a barrel vertical magnetic field formed in the vertical, i.e., V axis direction perpendicular to the traveling direction of the electron beam.

In this color picture tube, the in-line electron gun assembly converges three electron beams on the center of the phosphor screen 103 by decentering the positions of side beam passage holes formed in a lower-voltage grid and the positions of holes in a higher-voltage grid from each other. The three electron beams 106B, 106G, and 106R emitted by the electron gun assembly 107 are deflected in the horizontal and vertical directions by a nonuniform magnetic field generated by the deflection yoke 108, and scan the entire phosphor screen 103 via the shadow mask 104 in the horizontal and vertical directions while self-converging.

Figure 5A:
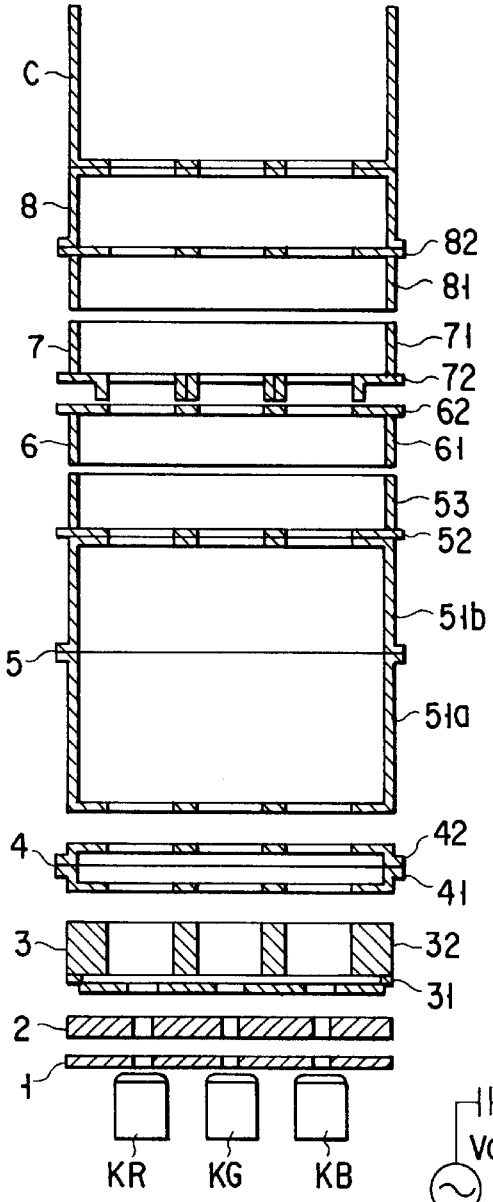
FIG. 5A is a cross-sectional view showing an electron gun assembly applied to a cathode ray tube according to the first embodiment of the present invention.
Figure 5B:
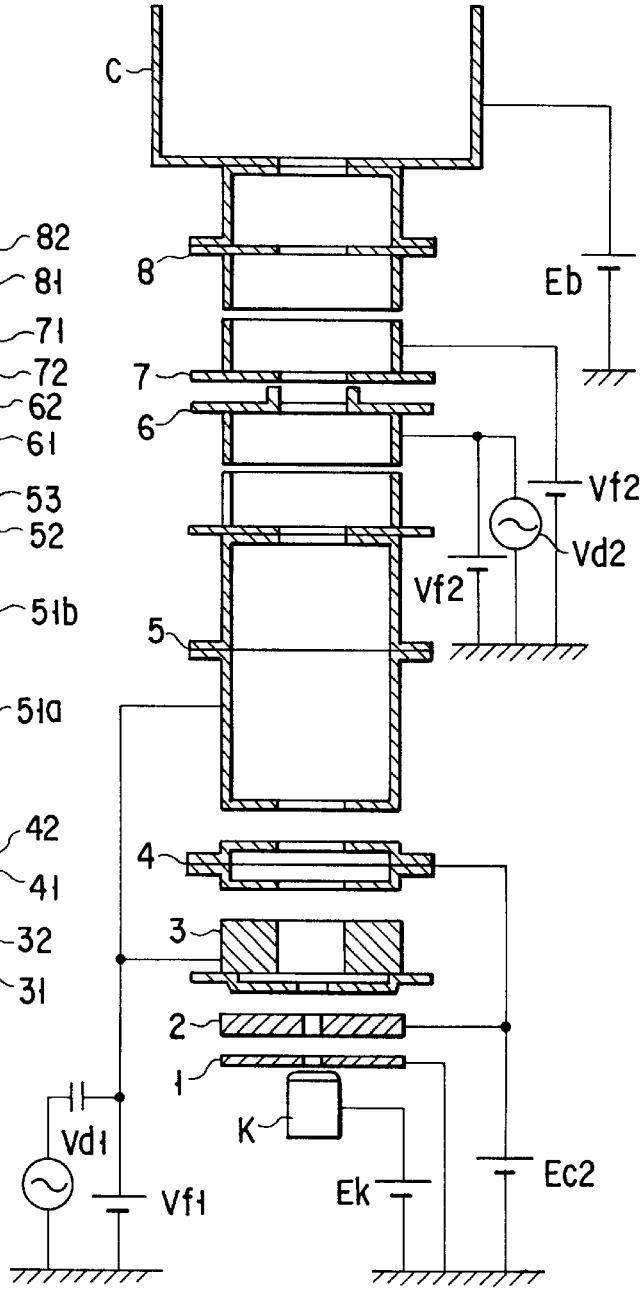
FIG. 5B is a longitudinal sectional view showing the electron gun assembly shown in FIG. 5A.

FIGS. 5A and 5B are schematic sectional views showing an electron gun assembly applied to a cathode ray tube according to the first embodiment of the present invention.

As shown in FIGS. 5A and 5B, the electron gun assembly comprises three cathodes K (B, G, R) each incorporating a heater (not shown), a first grid 1, a second grid 2, a third grid 3, a fourth grid 4, a fifth grid 5, a sixth grid 6, a seventh grid 7, an eighth grid 8, and a convergence cup C. The cathodes and the grids are placed in this order, and firmly supported by an insulating supporter (not shown).

The first grid 1 is a thin plate-like electrode having three small-diameter electron beam passage holes. The second grid 2 is a thin plate-like electrode having three small-diameter electron beam passage holes. The third grid 3 is constituted by a cup-like electrode 31 and a thick plate-like electrode 32. The cup-like electrode 31 has, in a surface facing the second grid 2, three electron beam passage holes slightly larger in diameter than the electron beam passage holes of the second grid 2. The thick plate-like electrode 32 has three larger-diameter electron beam passage holes. The fourth grid 4 is constituted by butt-joining the open ends of two cup-like electrodes 41 and 42. Each of the cup-like electrodes 41 and 42 has three large-diameter electron beam passage holes in a surface facing the third grid 3 or fifth grid 5.

Figure 7A:
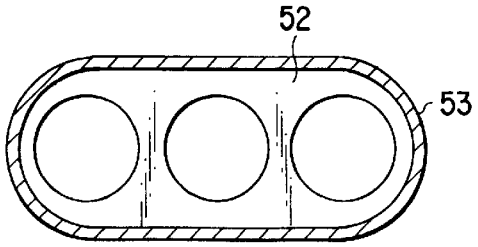
FIG. 7A is a front view of the cylindrical electrode of the electron gun assembly applied to the cathode ray tube of the present invention when viewed from the screen.
Figure 7B:
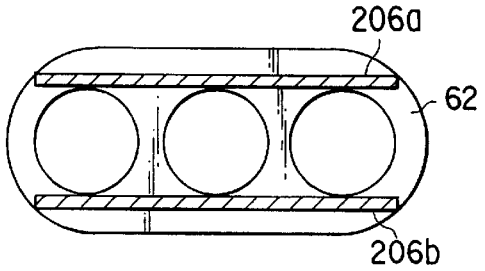
FIG. 7B is a front view of the plate-like electrode of the electron gun assembly when viewed from the screen.
Figure 7C:
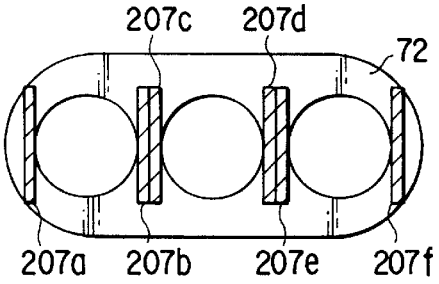
FIG. 7C is a front view of the plate-like electrode of the electron gun assembly when viewed from the cathode.
Figure 7D:
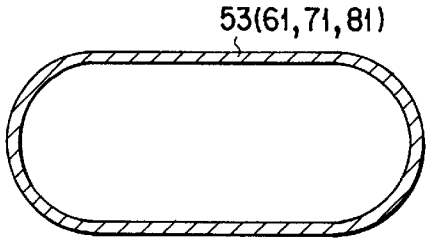
FIG. 7D is a front view of the cylindrical electrode of the electron gun assembly when viewed from the cathode.

The fifth grid 5 is composed of two cup-like electrodes 51*a* and 51*b* long in the traveling direction of the electron beam, a plate-like electrode 52, and a cylindrical electrode 53. Each of the bottom surfaces of the two cup-like electrodes 51*a* and 51*b*, and the plate-like electrode 52 has three electron beam passage holes. The cylindrical electrode 53 has an opening common to three electron beams, as shown in FIG. 7D. The fifth grid 5 has a shape shown in FIG. 7A when viewed from the sixth grid 6.

The sixth grid 6 is comprised of by a cylindrical electrode 61 like the one shown in FIG. 7D having an opening common to three electron beams, and a plate-like electrode 62 having three electron beam passage holes. As shown in FIG. 7B, in the plate-like electrode 62 peak-like electrodes 206*a* and 206*b* extending in the traveling direction in which the electron beam travels are integrally molded above and below the three electron beam passage holes on the seventh grid side.

The seventh grid 7 is constituted by a plate-like electrode 72 and a cylindrical electrode 71. In the plate-like electrode 72, peak-like electrodes 207*a*, 207*b*, 207*c*, 207*d*, 207*e*, and 207*f* extending in the direction in which the electron beam travels are respectively integrally molded on the right and left sides of three electron beam passage holes, as shown in FIG. 7C. The cylindrical electrode 71 has an opening common to three electron beams, as shown in FIG. 7D. This structure forms a strong quadrupole lens between the sixth grid 6 and the seventh grid 7 when the electron beam is deflected to the peripheral portion of the phosphor screen.

The eighth grid 8 is constituted by a cylindrical electrode 81 like the one shown in FIG. 7D having an opening common to three electron beams, and a plate-like electrode 82 having three electron beam passage holes. The eighth grid 8 has substantially the same shape as that of the fifth grid 5 shown in FIG. 7A when viewed from the seventh grid 7. The eighth grid 8 comprises the convergence cup C on the phosphor screen side.

In the electron gun assembly, as shown in FIG. 5B, the three cathodes K (B, G, R) receive an applied voltage EK of about 100 to 150V and a modulation signal for a picture, and the first grid 1 is grounded. The second grid 2 and the fourth grid 4 are connected inside the tube and receive an applied voltage EC2 of about 600 to 800V. The third grid 3 and the fifth grid 5 are connected inside the tube and receive an applied focusing voltage (Vf1+Vd1) around 6 to 9 kV on which a voltage which changes depending on the deflection amount of the electron beam is superposed.

The eighth grid 8 receives an applied anode voltage Eb of about 25 to 30 kV. The sixth grid 6 and the seventh grid 7 receive nearly middle voltages between the voltages to the eighth grid 8 and the fifth grid 5. For example, the sixth grid 6 receives an applied voltage (Vf2+Vd2) of about 12 to 26 kV on which a voltage which changes depending on the deflection amount of the electron beam is superposed, whereas the seventh grid 7 receives an applied voltage Vf2 of about 12 to 26 kV.

The lens system whose electric field is extended by the intermediate electrodes between the fifth grid 5 and the eighth grid 8, i.e., the sixth grid 6 and the seventh grid 7 forms a main electron lens portion to constitute a large-aperture, long-focal-length lens. This structure can reproduce a smaller electron beam spot on the screen.

This main electron lens has a first lens region formed by the voltage difference between the fifth grid 5 and the sixth grid 6, a second lens region formed by the voltage difference between the sixth grid 6 and the seventh grid 7, and a third lens region formed by the voltage difference between the seventh grid 7 and the eighth grid 8.

Figure 6A:
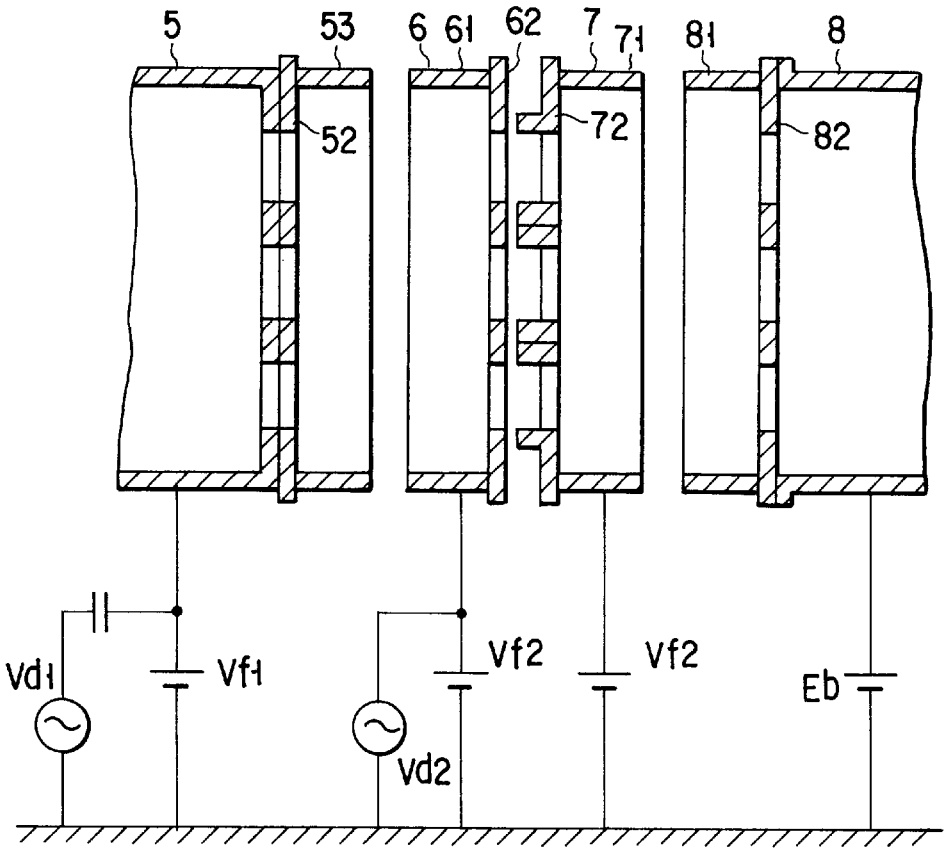
FIG. 6A is a view schematically showing the arrangement of the main electron lens portion of the electron gun assembly shown in FIG. 5A.
Figure 6B:
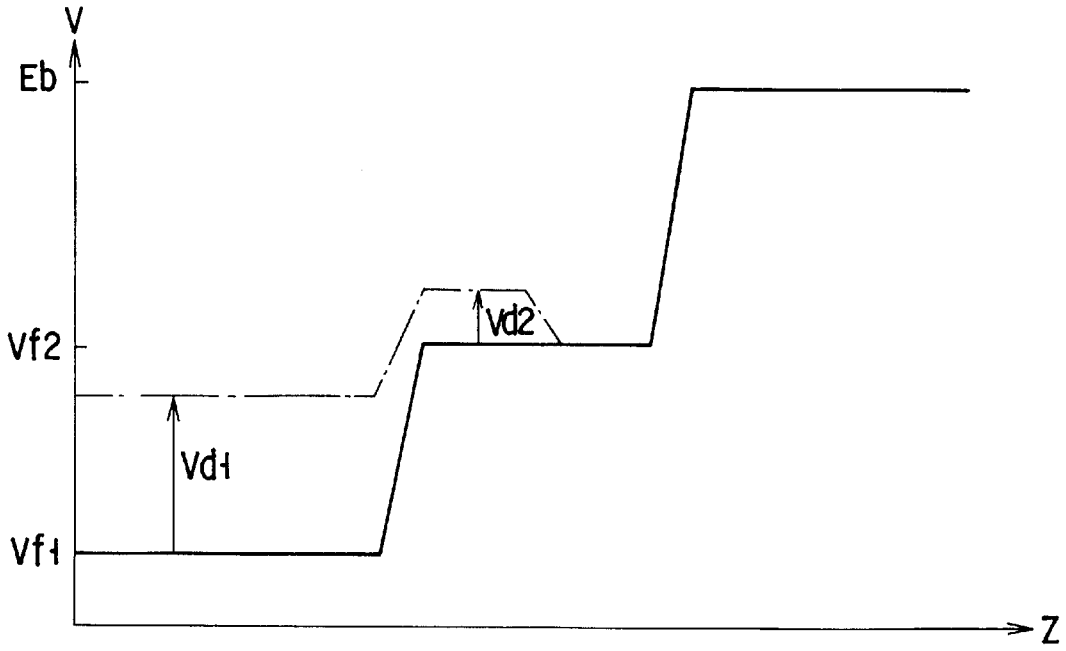
FIG. 6B is a graph showing the distribution of the voltage level applied to each grid of the main electron lens portion shown in FIG. 6A.

FIG. 6A shows the schematic arrangement of the main electron lens portion formed by the fifth to eighth grids 5 to 8. FIG. 6B shows the distribution of the voltage applied to these grids. In FIG. 6B, the solid line represents the voltage distribution when electron beams are not deflected and focus on the center of the phosphor screen. The broken line represents the voltage distribution when electron beams are deflected and focus on the peripheral portion of the phosphor screen.

The fifth grid 5 receives a parabolic dynamic voltage Vd1 which uses a voltage Vf1 as a reference voltage and changes depending on the deflection amount of the electron beam. That is, when the electron beam is not deflected, the fifth grid 5 receives only the applied reference voltage Vf1, and when the electron beam is deflected a voltage obtained by superposing the dynamic voltage Vd1 on the reference voltage Vf1.

The sixth grid 6 receives a parabolic dynamic voltage Vd2 which uses a voltage Vf2 as a reference voltage higher than the voltage Vf1 and changes depending on the deflection amount of the electron beam. That is, when the electron beam is not deflected, the sixth grid 6 receives only the applied reference voltage Vf2, and when the electron beam is deflected a voltage obtained by superposing the dynamic voltage Vd2 on the reference voltage Vf2.

The seventh grid 7 receives the applied voltage Vf2, while the eighth grid 8 receives the applied anode voltage Eb higher than the voltage Vf2.

In the first embodiment, the voltage applied to the fifth grid 5 when the electron beam is deflected, i.e., (Vf1+Vd1) is set lower than Vf2. The voltage applied to the sixth grid 6 when the electron beam is deflected, i.e., (Vf2+Vd2) is set lower than the anode voltage Eb.

Figure 8:
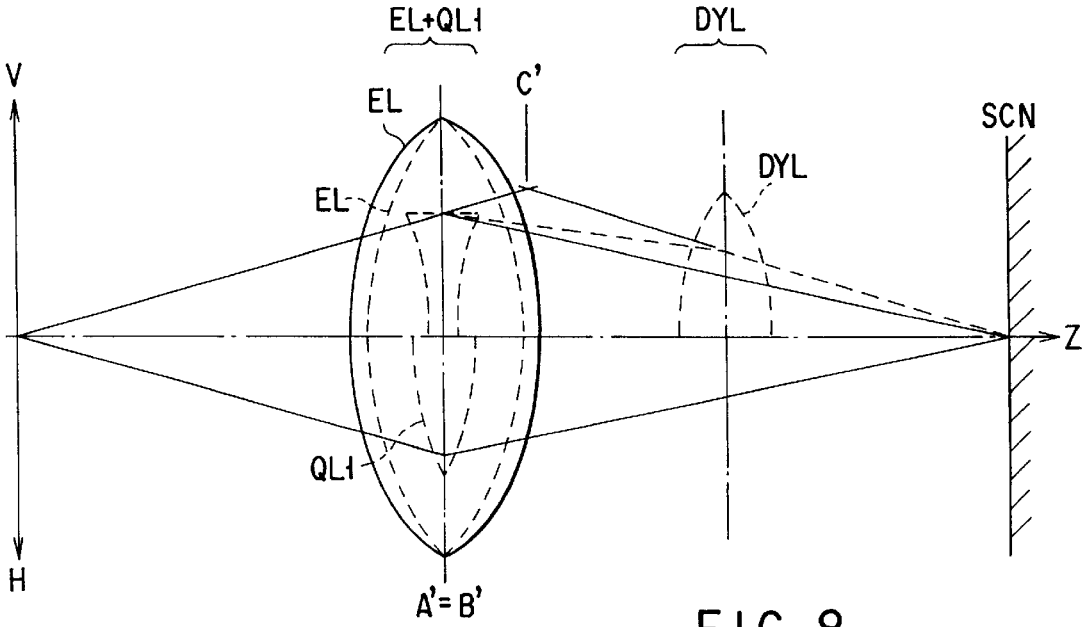
FIG. 8 is a view for explaining the electron beam orbit and the lens operation in the electron gun assembly shown in FIG. 5A.

FIG. 8 is a view showing the lens operation of the main electron lens portion in this case, and the electron beam orbit by this lens. In FIG. 8, the solid lines represent the electron beam orbit and the lens operation when the electron beam is not deflected, and the broken lines represent the electron beam orbit and the lens operation when the electron beam is deflected.

As shown in FIG. 8, in the electron gun assembly applied to the cathode ray tube of the present invention, a quadrupole lens portion QL1 is positioned at almost the center of a main electron lens portion EL.

More specifically, as shown in FIG. 6B, as the electron beam is deflected from the center of the screen to the peripheral portion, a voltage obtained by superposing the dynamic voltage Vd1 on the voltage Vf1 is applied to the fifth grid 5 to reduce the voltage difference between the fifth to eighth grids. Then, the power of the field-extended main electron lens portion EL formed by the fifth to eighth grids weakens from the solid line to the broken line.

When the electron beam is not deflected, the same DC voltage Vf2 is applied to both the sixth grid 6 and the seventh grid 7, and thus no voltage difference appears. As the electron beam is deflected from the center of the screen to the peripheral portion, the AC voltage Vd2 is further applied to only the sixth grid 6, as shown in FIG. 6B. This AC voltage Vd2 produces a voltage difference between the sixth grid 6 and the seventh grid 7 to form the quadrupole lens portion QL1. The quadrupole lens portion QL1 is formed inside the main electron lens portion EL, as shown in FIG. 8.

In other words, the quadrupole lens portion QL1 inserted between the sixth grid 6 and the seventh grid 7 is operated by the voltage difference produced by the AC voltage Vd2 applied to the sixth grid 6. As the electron beam is deflected from the center of the screen to the peripheral portion, the quadrupole lens portion QL1 exhibits focusing action in the horizontal direction H and divergent action in the vertical direction V, as indicated by the broken lines in FIG. 8.

In FIG. 8, since the color cathode ray tube has a self-convergence deflecting magnetic field, a deflection yoke lens DYL having a focusing force in only the vertical direction V while keeping a focusing force in the horizontal direction H is generated. In FIG. 8, therefore, the lens action of the deflecting magnetic field in the horizontal direction H is not illustrated.

When the electron beam is deflected, the lens action of the main electron lens portion EL and the quadrupole lens portion QL1 maintains the same focusing force in the horizontal direction as when the electron beam is not deflected. That is, when the electron beam is deflected, the lens action of the main electron lens portion EL weakens as a whole. At this time, in the horizontal direction H, the weakened lens action of the main electron lens portion EL is compensated for by the focusing lens action of the quadrupole lens portion QL1 formed inside the main lens portion EL. The strong focusing action of the deflection yoke lens DYL is compensated by the total lens action which concludes the weakened lens action of the main lens portion EL and the divergent lens action of the quadrupole lens portion QL1 formed inside the main lens portion EL.

When the electron beam is deflected, the electron beam orbit in the vertical direction V is indicated by the broken line in FIG. 8. The electron beam orbit in the horizontal direction H is the same as when the beam is not deflected because the position of the quadrupole lens QL1 substantially coincides with the position of the main electron lens EL.

The principal plane of the lens, i.e., virtual lens center (cross point between the orbit of a beam emitted by the cathode and the orbit of a beam incident on the phosphor screen) when electron beams are focused on the phosphor screen remains unchanged in the horizontal direction H irrespective of whether the electron beams are deflected. That is, principal plane position B' of the lens in focusing electron beams on the peripheral portion of the screen coincides with principal plane position A' of the lens in focusing electron beams on the center of the screen.

Since the principal plane position virtually does not move in focusing electron beams on the peripheral portion of the screen, the horizontal magnification does not change. This suppresses any excessive increase in the horizontal beam diameter of the beam spot formed by the electron beam passing through the quadrupole lens portion QL1 and the main electron lens portion EL.

Figure 1A:
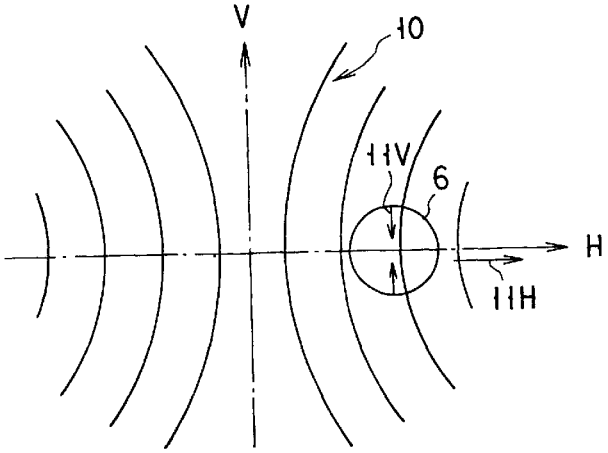
FIG. 1A (PRIOR ART)
FIGS. 1A and 1B are views for explaining vertical collapse of the spot formed by the electron beam in the presence of a pincushion deflecting magnetic field.
Figure 1B:
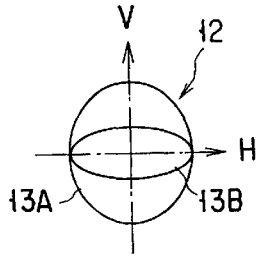
FIG. 1B (PRIOR ART)
Figure 2A:
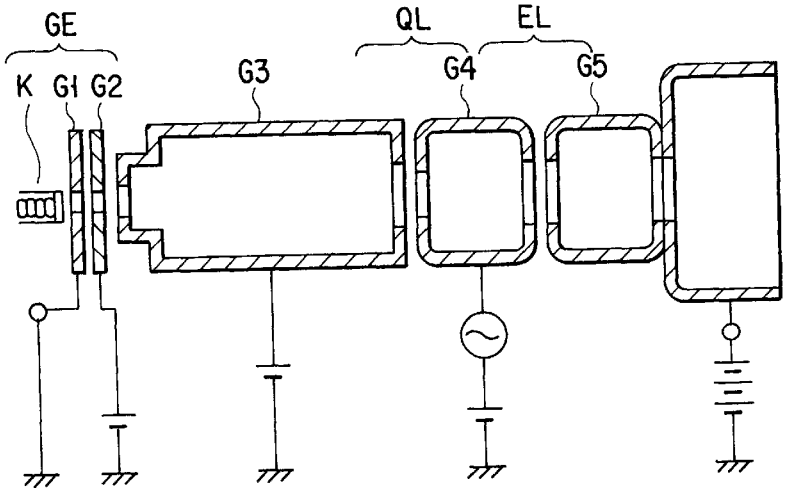
FIG. 2A (PRIOR ART)
FIG. 2A is a sectional view showing the structure of a conventional electron gun assembly.
Figure 2B:
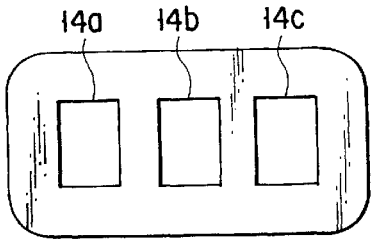
FIG. 2B (PRIOR ART)
FIGS. 2B and 2C are front views each showing a plate-like electrode forming a quadrupole lens applied to the electron gun assembly.
Figure 2C:
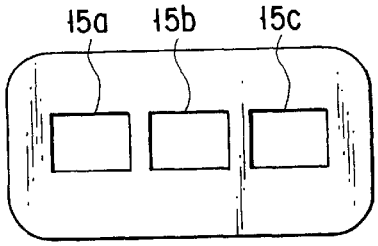
FIG. 2C (PRIOR ART)
Figure 3:
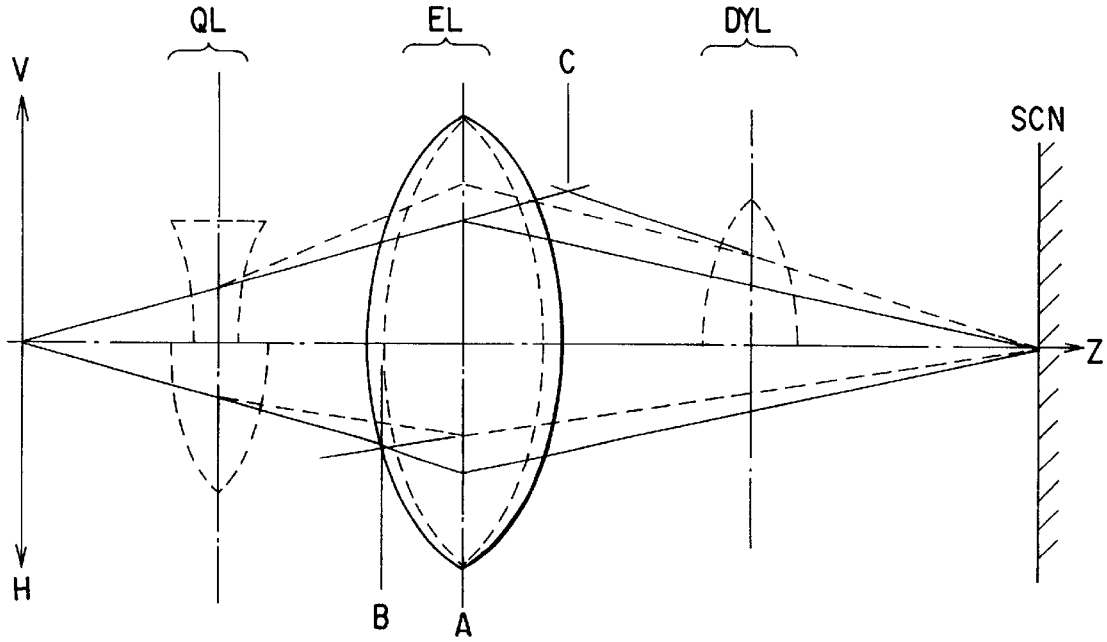
FIG. 3 (PRIOR ART)
FIG. 3 is a view for explaining the electron beam orbit and the lens operation in the electron gun assembly shown in FIG. 2A.

In the vertical direction V, although principal plane position C' moves forward to a screen SCN by a distance corresponding to the generated deflection yoke lens DYL, position C' is nearer the cathode, compared to conventional principal plane position C in the conventional electron gun assembly shown in FIG. 3. In the conventional electron gun assembly shown in FIG. 3, the quadrupole lens portion QL formed when the electron beam is deflected is positioned nearer the cathode than the main electron lens portion EL and diverges the electron beam in the vertical direction V, so that the orbit of the electron beam moves apart from a central axis Z. As a result, principal plane position C moves forward to the screen.

On the other hand, in the electron gun assembly shown in FIG. 8, the quadrupole lens portion QL1 is located inside the main electron lens portion EL. For this reason, the orbit of the electron beam passing through the main electron lens portion EL is not changed by the quadrupole lens portion QL1, and principal plane position C' in the vertical direction when the electron beam is deflected is nearer the cathode, compared to principal plane position C in the conventional electron gun assembly.

Although the principal plane position moves forward to the screen in focusing electron beams on the peripheral portion of the screen, the forward movement amount is smaller than in the conventional electron gun assembly in which the quadrupole lens portion QL is placed nearer the cathode than the main electron lens portion EL. Thus, a decrease in vertical magnification can be suppressed, compared to the conventional electron gun assembly. Excessive decrease in the vertical beam diameter of the electron beam passing through the quadrupole lens portion QL1 and the main electron lens portion EL can be suppressed. That is, the vertical diameter of the electron beam at the peripheral portion of the screen can be maintained.

In this manner, inserting the quadrupole lens portion inside the main electron lens portion substantially prevents the principal plane of the lens in the horizontal direction H from moving in focusing electron beams at the peripheral portion of the screen. Horizontal enlargement of the beam shape of the electron beam can be suppressed. Further, the movement amount of the principal plane of the lens toward the screen in the vertical direction V can also be suppressed. Therefore, vertical collapse of the beam shape of the electron beam can be reduced.

A rounder electron beam spot can therefore be obtained over the entire screen, compared to the conventional electron gun assembly.

Applying this electron gun assembly to the cathode ray tube leads to a high resolution over the entire screen while suppressing vertical collapse of the spot at the peripheral portion of the screen.

The first embodiment of the present invention has been described above, but the present invention is not limited to this.

Figure 11A:
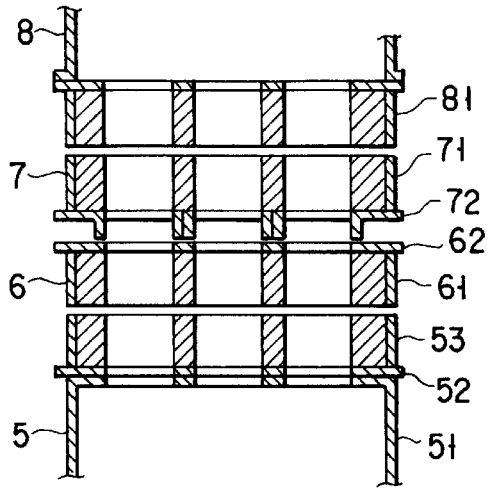
FIG. 11A is a cross-sectional view schematically showing the main electron lens portion of another electron gun assembly according to the first embodiment.
Figure 11B:
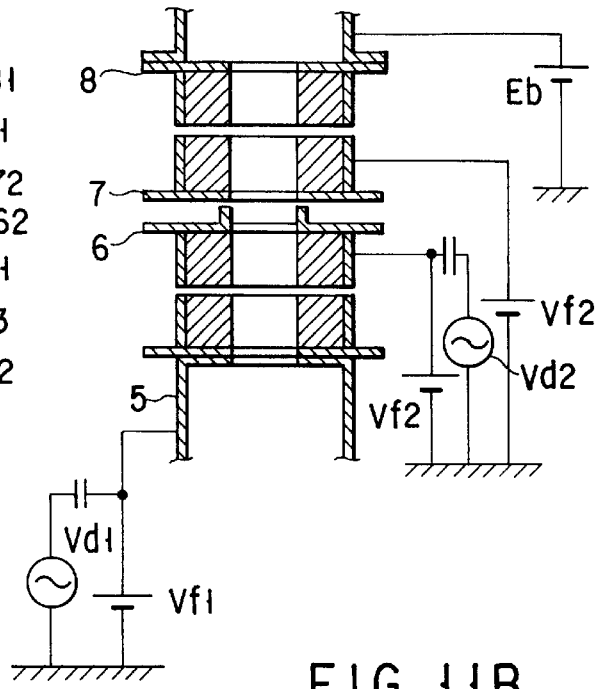
FIG. 11B is a longitudinal sectional view of the main electron lens portion shown in FIG. 11A.

More specifically, the grids 5 to 8 of the main electron lens portion EL are not limited to combinations of the cup-like electrode and the plate-like electrode shown in FIGS. 5A and 5B. As shown in FIGS. 11A and 11B, if thick plate-like electrodes 53, 61, 71, and 81 each having electron beam passage holes are applied to the fifth to eighth grids, the same effects as those in the electron gun assembly shown in FIGS. 5A and 5B can also be obtained.

Figure 12:
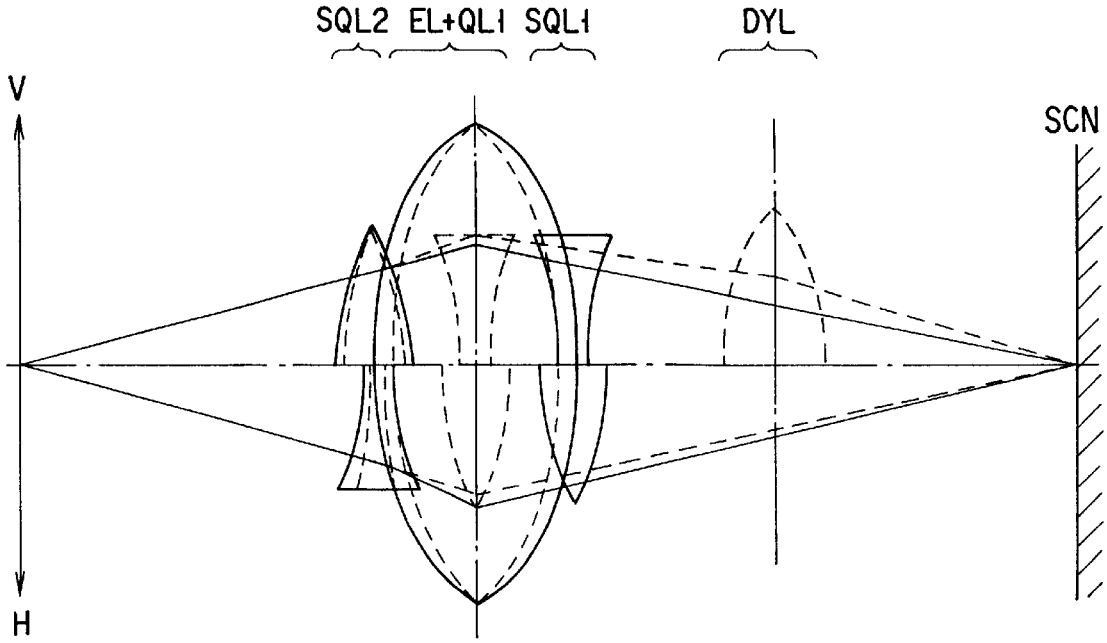
FIG. 12 is a view for explaining the electron beam orbit and the lens operation in another electron gun assembly according to the first embodiment.

Also, the structure of the main electron lens portion EL is not limited to the one shown in FIG. 8. For example, as shown in FIG. 12, if quadrupole components SQL1 and SQL2 are further inserted on the two sides of a main electron lens (EL+QL1) incorporating the quadrupole lens portion, the same effects as those in the main electron lens portion having the arrangement shown in FIG. 8 can be obtained.

In the electron gun assembly having the arrangement shown in FIGS. 5A and 5B, the voltage is individually applied to the grids 5 to 8 forming the main electron lens portion EL. However, the present invention is not limited to this. For example, a voltage prepared by dividing the anode voltage by the resistor may be applied to the grids.

The same voltage Vf2 is applied to the sixth grid 6 and the seventh grid 7, but the present invention is not limited to this. The second embodiment will be described in detail below. The same reference numerals as in the first embodiment denote the same parts, and a detailed description thereof will be omitted.

Figure 13A:
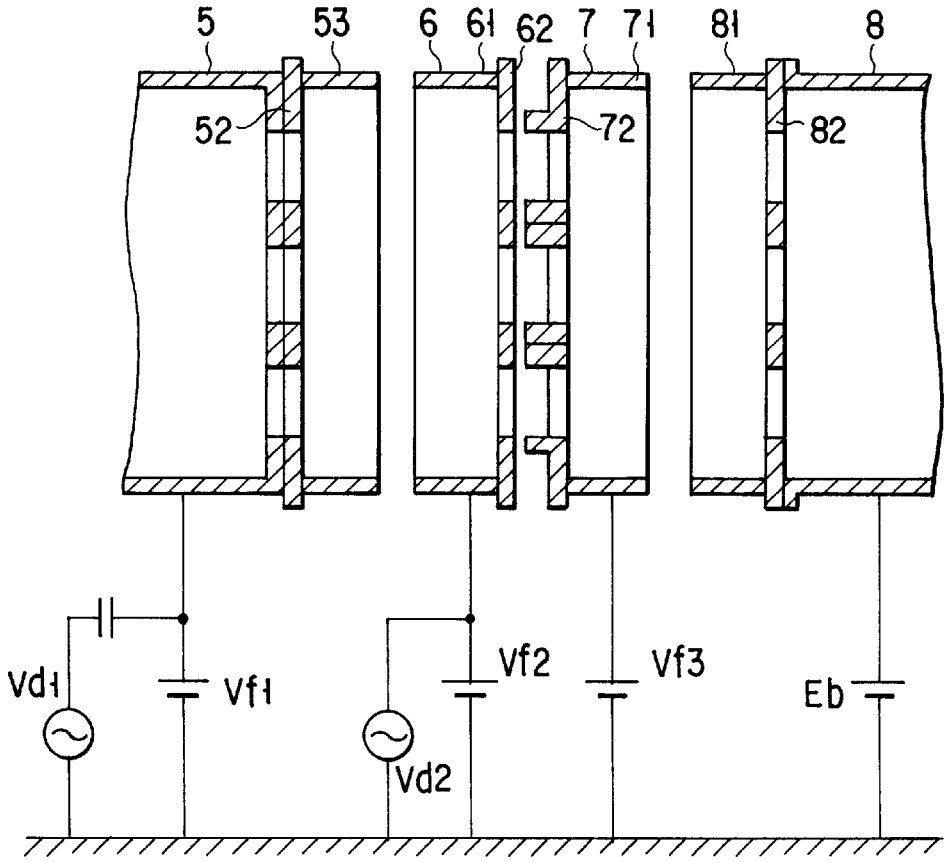
FIG. 13A is a view schematically showing the arrangement of the main electron lens portion of an electron gun assembly applied to a cathode ray tube according to the second embodiment of the present invention.
Figure 13B:
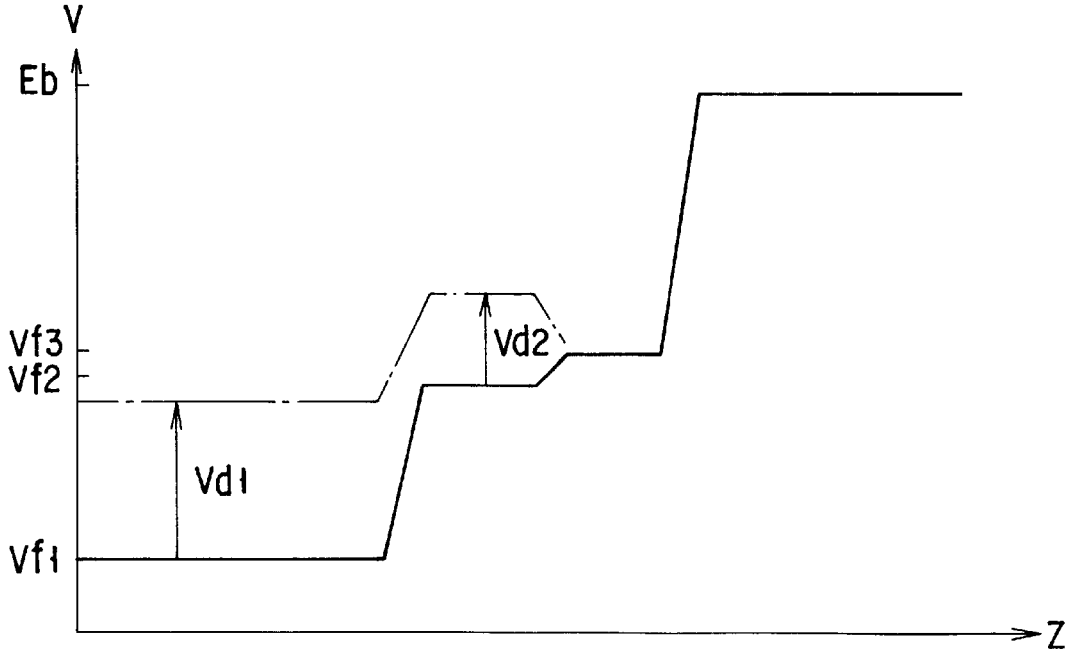
FIG. 13B is a graph showing the distribution of the voltage level applied to each grid of the main electron lens portion shown in FIG. 13A.

FIG. 13A schematically shows fifth to eighth grids 5 to 8 forming the main electron lens portion of an electron gun assembly according to the second embodiment of the present invention. FIG. 13B shows the distribution of the voltage applied to these grids. In FIG. 13B, the solid line represents the voltage distribution when the electron beam is not deflected, and the broken line represents the voltage distribution when the electron beam is deflected.

More specifically, as shown in FIG. 13A, a main electron lens portion EL of this electron gun assembly is made up of the fifth to eighth grids 5 to 8 each having the same shape as in the first embodiment shown in FIG. 6A.

When the electron beam is not deflected, the fifth grid 5 receives only the reference voltage Vf1, and when the electron beam is deflected a voltage obtained by superposing, on the reference voltage Vf1, the dynamic voltage Vd1 which parabolically changes depending on the deflection amount of the electron beam. The voltage (Vf1+Vd1) applied to the fifth grid 5 is about 6 to 9 kV.

When the electron beam is not deflected, the sixth grid 6 receives only the reference voltage Vf2 higher than the voltage Vf1, and when the electron beam is deflected a voltage obtained by superposing, on the reference voltage Vf2, the dynamic voltage Vd2 which parabolically changes depending on the deflection amount of the electron beam. The voltage (Vf2+Vd2) applied to the sixth grid 6 is about 12 to 26 kV.

The seventh grid 7 receives the voltage Vf3 higher than the voltage Vf2. The voltage Vf3 applied to the seventh grid 7 is about 12 to 26 kV.

The eighth grid 8 receives the anode voltage Eb higher than the voltage Vf3. The voltage Eb applied to the eighth grid 8 is about 25 to 30 kV.

According to the second embodiment, as shown in FIG. 13B, when the electron beam is not deflected, the voltage Vf1 applied to the fifth grid 5 is set lower than the voltage Vf2 applied to the sixth grid 6, the voltage Vf2 is set lower than the voltage Vf3 applied to the seventh grid 7, and the voltage Vf3 is set lower than the anode voltage Eb.

When the electron beam is deflected, the voltage (Vf1+Vd1) applied to the fifth grid 5 is set lower than the voltage Vf2. The voltage (Vf2+Vd2) applied to the sixth grid is set lower than the anode voltage Eb and higher than the voltage Vf3.

The voltage difference generated between the sixth grid 6 and the seventh grid 7 forms a quadrupole lens irrespective of whether the electron beams are deflected.

Figure 14:
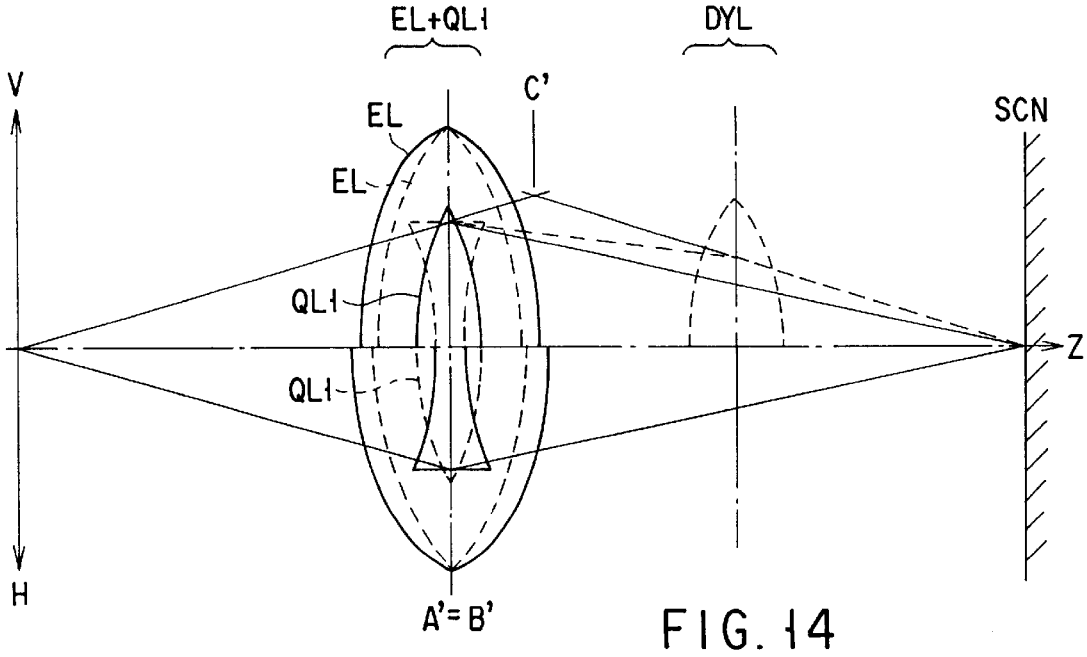
FIG. 14 is a view for explaining the electron beam orbit and the lens operation in the electron gun assembly shown in FIG. 13A.

FIG. 14 is a view showing the lens operation of the main electron lens portion in this case, and the electron beam orbit by this lens. In FIG. 14, the solid lines represent the electron beam orbit and the lens operation when the electron beam is not deflected, and the broken lines represent the electron beam orbit and the lens operation when the electron beam is deflected.

As shown in FIG. 14, in the electron gun assembly applied to the cathode ray tube of the second embodiment, a quadrupole lens portion QL1 formed between the sixth grid and the seventh grid is positioned at almost the center of the main electron lens portion EL formed by the fifth to eighth grids.

More specifically, as shown in FIG. 13B, as the electron beam is deflected from the center of the screen to the peripheral portion, a voltage obtained by superposing the dynamic voltage Vd1 on the voltage Vf1 is applied to the fifth grid 5 to decrease the voltage difference between the fifth to eighth grids. Then, the power of the field-extended main electron lens portion EL formed by the fifth to eighth grids weakens from the solid line to the broken line.

When the electron beam is not deflected, as indicated by the solid line, the voltage Vf2 is applied to the sixth grid 6, whereas the voltage Vf3 higher than the voltage Vf2 is applied to the seventh grid 7. The voltage difference between Vf2 and Vf3 forms the quadrupole lens portion QL1. The formed quadrupole lens portion QL1 has divergent action in the horizontal direction H and focusing action in the vertical direction V, as indicated by the solid lines.

When the electron beam is deflected, as shown in FIG. 13B, the AC voltage Vd2 is further applied to only the sixth grid 6. That is, a voltage (Vf2+Vd2) higher than the voltage Vf3 of the seventh grid 7 is applied to the sixth grid 6, and the voltage difference between (Vf2+Vd2) and Vf3 forms the quadrupole lens QL1. The polarity of this voltage difference is opposite to that of the voltage difference generated when the electron beam is not deflected because the voltage applied to the sixth grid is set higher. Accordingly, the quadrupole lens portion QL1 formed when the electron beam is deflected has focusing action in the horizontal direction H and divergent action in the vertical direction V, as indicated by the broken lines.

In the second embodiment, the quadrupole lens portion QL1 formed inside the main electron lens portion EL has a horizontal component that changes from divergent action to focusing action and a vertical component that changes from focusing action to divergent action with an increase in deflection amount of the electron beam. The quadrupole lens portion having this arrangement improves the sensitivity in comparison with a quadrupole lens having a horizontal component which changes to have focusing action in an OFF state and a vertical component which changes to have divergent action in an OFF state according to the first embodiment.

Therefore, since the quadrupole lens portion QL1 has divergent action in the horizontal direction and focusing action in the vertical direction when the electron beam is not deflected, the main electron lens portion EL has focusing action in the horizontal direction stronger than that in the vertical direction.

When the electron beam is deflected, the power of the main electron lens portion EL weakens as a whole. The quadrupole lens portion QL1 formed inside the main electron lens portion EL has a horizontal component that changes from divergent action to focusing action and a vertical component that changes from focusing action to divergent action.

Therefore, in the vertical direction, the deflected electron beam passes along the orbit indicated by the broken line in FIG. 14. In the horizontal direction, the deflected electron beam passes through the same orbit as when the electron beam is not deflected because the position of the quadrupole lens QL1 substantially coincides with the position of the main electron lens EL.

The principal plane of the lens in the horizontal direction H remains unchanged irrespective of whether the electron beams are deflected. That is, principal plane position B' of the lens when the electron beam is deflected coincides with principal plane position A' of the lens when the electron beam is not deflected.

Since the principal plane position essentially does not move in the horizontal direction H when the electron beam is deflected and nondeflected, the horizontal magnification does not change. This suppresses excessive increase in the horizontal beam diameter of the electron beam passing through the quadrupole lens portion QL1 and the main electron lens portion EL.

In the vertical direction V, although principal plane position C' of the lens moves forward to the screen SCN by a distance corresponding to the generated deflection yoke lens DYL, position C' is nearer the cathode, compared to conventional principal plane position C in the conventional electron gun assembly. In the conventional electron gun assembly, the quadrupole lens QL is arranged at the cathode side of the main electron lens EL, and the electron beam orbit is diverged by the quadrupole lens QL to pass through a position apart from the central axis Z.

As a result, principal plane position C moves forward to the screen SCN. On the other hand, in the electron gun assembly according to the second embodiment shown in FIG. 14, the quadrupole lens portion QL1 is inside the main electron lens portion EL. For this reason, the orbit of the electron beam passing through the main electron lens portion EL does not change despite the quadrupole lens portion QL1, and principal plane position C' in the vertical direction upon movement is nearer the cathode, compared to principal plane position C in the conventional electron gun assembly.

Although the principal plane position in the vertical direction moves forward to the screen when the electron beam is deflected, the forward movement amount is smaller than in the case in which the quadrupole lens portion is arranged at the cathode side of the main electron lens portion. A decrease in vertical magnification can be suppressed, compared to the conventional electron gun assembly. Excessive decrease in the vertical beam diameter of the electron beam passing through the quadrupole lens portion QL1 and the main electron lens portion EL can be suppressed. That is, the vertical diameter of the electron beam at the peripheral portion of the screen can be maintained, compared to the conventional electron gun assembly.

A rounder electron beam spot can therefore be obtained over the entire screen, compared to the conventional electron gun assembly.

Applying this electron gun assembly to the cathode ray tube leads to a high resolution over the entire screen while suppressing vertical collapse of the spot at the screen periphery.

The second embodiment of the present invention has been described above, but the present invention is not limited to this.

Figure 15A:
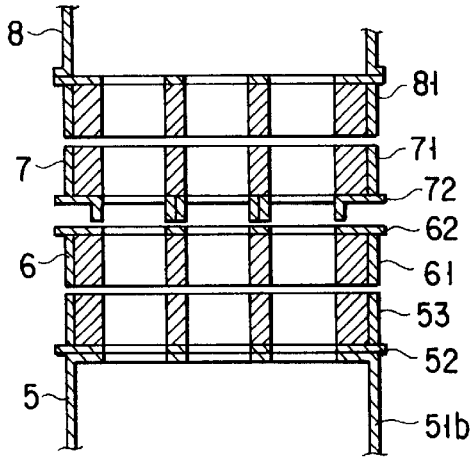
FIG. 15A is a cross-sectional view schematically showing the main electron lens portion of another electron gun assembly according to the second embodiment.
Figure 15B:
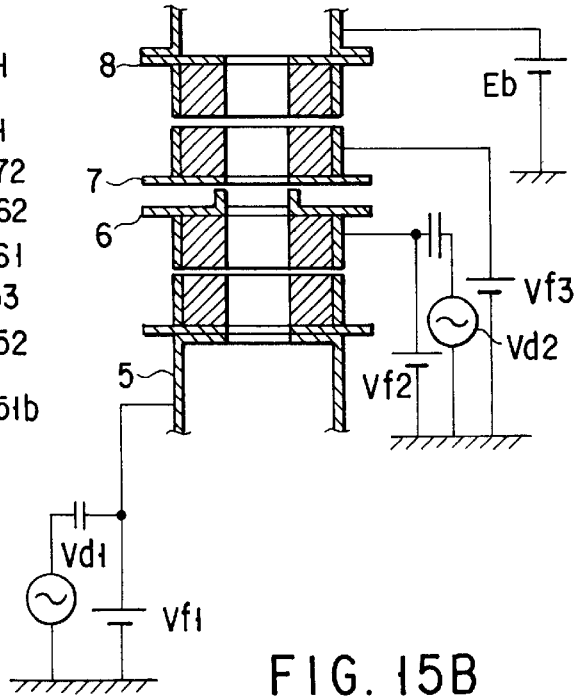
FIG. 15B is a longitudinal sectional view of the main electron lens portion shown in FIG. 15A.

More specifically, the grids 5 to 8 of the main electron lens portion EL are not limited to combinations of the cup-like electrode and the plate-like electrode shown in FIG. 13A. As shown in FIGS. 15A and 15B, if thick plate-like electrodes 53, 61, 71, and 81 each having electron beam passage holes are applied to the fifth to eighth grids, the same effects as those in the electron gun assembly shown in FIG. 13A can also be obtained.

Figure 16:
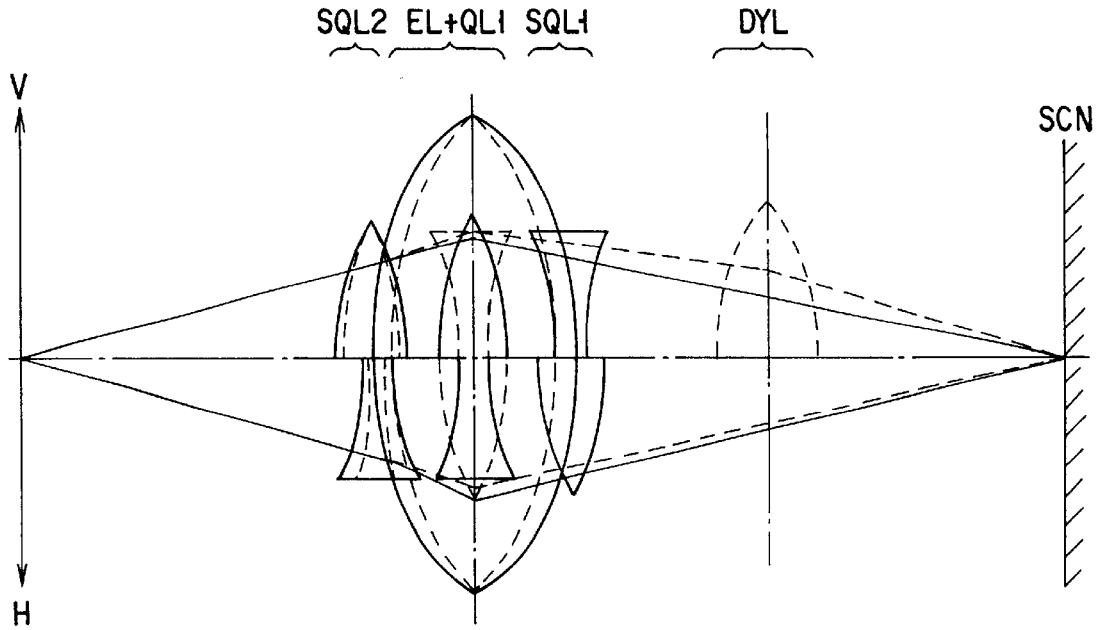
FIG. 16 is a view for explaining the electron beam orbit and the lens operation in another electron gun assembly according to the second embodiment.

Also, the arrangement of the main electron lens portion EL is not limited to the one shown in FIG. 14. For example, as shown in FIG. 16, if quadrupole components SQL1 and SQL2 are further inserted on the two sides of a main electron lens (EL+QL1) incorporating the quadrupole lens portion QL1, the same effects as those in the main electron lens portion having the arrangement shown in FIG. 14 can be obtained.

In the electron gun assembly having the arrangement shown in FIG. 13A, the voltage is individually applied to the grids 5 to 8 forming the main electron lens portion EL. However, the present invention is not limited to this. For example, a voltage prepared by dividing the anode voltage by the resistor may be applied to the grids.

The application voltage level is set such that the voltage of the seventh grid becomes lower than the voltage of the sixth grid when the electron beam is not deflected, and higher when the electron beam is deflected. This voltage level relationship may be reversed.

The shape of each grid constituting the main electron lens portion is not limited to the first and second embodiments described above.

Figure 9A:
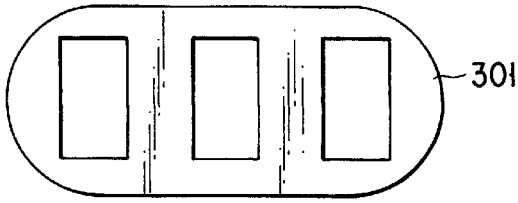
FIGS. 9A and 9B are views schematically showing plate-like electrodes combined to form another quadrupole lens portion.
Figure 9B:
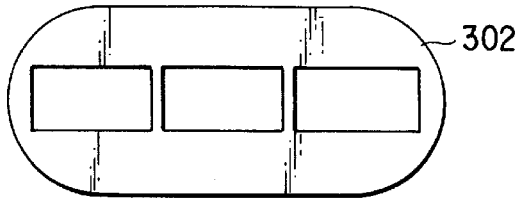

For example, in the first and second embodiments, the quadrupole lens portion interposed between the sixth grid 6 and the seventh grid 7 is formed by arranging peak-like electrodes on the upper and lower sides, and right and left sides of electron beam passage holes. However, the shape is not limited to this. For example, the quadrupole lens portion formed between the sixth grid 6 and the seventh grid 7 may be formed by a combination of a plate-like electrode 301 having noncircular electron beam passage holes, i.e., vertically elongated holes and a plate-like electrode 302 having horizontally elongated holes, as shown in FIGS. 9A and 9B.

Figure 10A:
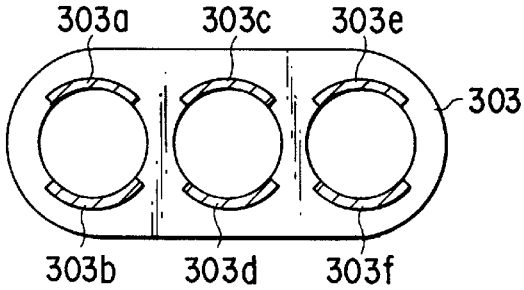
FIGS. 10A and 10B are views schematically showing electrodes combined to form still another quadrupole lens.
Figure 10B:
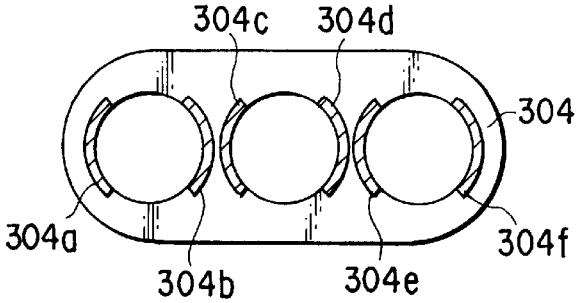

Alternatively, as shown in FIGS. 10A and 10B, the quadrupole lens may be formed by a combination of a plate-like electrode 303 having upper and lower peak-like electrodes 303*a*, 303*b*, 303*c*, 303*d*, 303*e*, and 303*f* along the arcs of corresponding electron beam passage holes, and a plate-like electrode 304 having right and left peak-like electrodes 304*a*, 304*b*, 304*c*, 304*d*, 304*e*, and 304*f*.

That is, the quadrupole lens applied to the electron gun assembly of the embodiments suffices to have a structure capable of producing a difference in lens power between the vertical and horizontal directions. The lens power is preferably stronger.

Figure 9C:
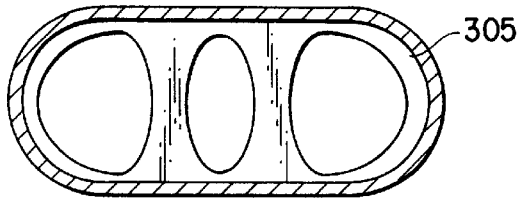
FIG. 9C is a view showing another example of the plate-like electrode applied to the electron gun assembly of the present invention.

The shape of the opening formed in the plate-like electrode arranged in each of the fifth grid 5 and the eighth grid 8 is not limited to the above embodiments. For example, as shown in FIG. 9C, a plate-like electrode 305 having a vertically elongated elliptical center beam passage hole and substantially triangular side beam passage holes may be applied. Applying the plate-like electrode 305 having this structure can correct comma of the electron lens arising from the influence of the cylindrical electrode.

Figure 9D:
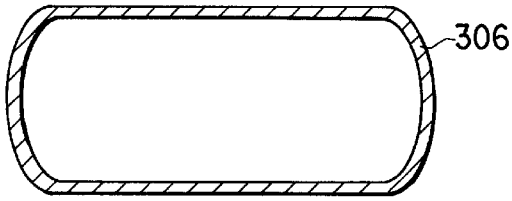
FIG. 9D is a view showing another example of the cylindrical electrode applied to the electron gun assembly of the present invention.

Further, the cylindrical electrode applied to the electron gun assembly is not limited to the above embodiments, and may be a cylindrical electrode 306 having an almost rectangular section as shown in FIG. 9D.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube comprising:

an electron gun assembly having an electron beam forming portion for forming and emitting at least one electron beam and a main electron lens portion for accelerating and focusing the at least one electron beam; and a deflection yoke for generating a deflecting magnetic field for deflecting the at least one electron beam emitted by said electron gun assembly and scanning a screen in vertical and horizontal directions, the main electron lens portion having a plurality of electrode structures arranged in a traveling direction of the at least one electron beam;

wherein a substantially increasing voltage distribution is applied to the plurality of electrode structures, including first and second dynamic voltages applied to respective electrode structures of said plurality of electrode structures, the relative arrangement of said plurality of electrode structures and the application of the substantially continuously increasing voltage distribution thereon causing there to be formed an asymmetrical lens between respective electrode structures configured to apply horizontal and vertical focusing forces on the at least one electron beam, the horizontal and vertical focusing forces having respective varying magnitudes;

and wherein a lens action of the asymmetrical lens providing the horizontal and vertical focusing forces changes in synchronism with the deflecting magnetic field.

2. A tube according to claim 1, wherein the main electron lens portion comprises a plurality of electrodes including an electrode receiving a first-level voltage, an electrode receiving a second-level voltage higher than the first level, and at least two intermediate electrodes which are arranged between the two electrodes and receive voltages in substantially the same level between the first and second levels, and the asymmetrical lens is formed between the two intermediate electrodes.

3. A tube according to claim 1, wherein the voltage potential along the traveling direction of the electron beam in the main electron lens portion substantially sequentially increases when the electron beam is not deflected.

4. A cathode ray tube comprising:

an electron gun assembly having an electron beam forming portion for forming and emitting at least one electron beam and a main electron lens portion for accelerating and focusing the at least one electron beam; and a deflection yoke for generating a deflecting magnetic field for deflecting the at least one electron beam emitted by said electron gun assembly and scanning a screen in vertical and horizontal directions, the main electron lens portion having a plurality of electrode structures arranged in a traveling direction of the at least one electron beam;

wherein a substantially increasing voltage distribution is applied to the plurality of electrode structures, including first and second dynamic voltages applied to respective electrode structures of said plurality of electrode structures, the relative arrangement of said plurality of electrode structures and the application of the substantially continuously increasing voltage distribution thereon causing there to be formed an asymmetrical lens between respective electrode structures configured to apply horizontal and vertical focusing forces on the at least one electron beam, the horizontal and vertical focusing forces having respective varying magnitudes;

and wherein a lens action of the asymmetrical lens providing the horizontal and vertical focusing forces changes in synchronism with the deflecting magnetic field, and the asymmetrical lens acts to have a horizontal component of focusing action and a vertical component of divergent action, as a deflection amount of the electron beam is increased by the deflecting magnetic field so that the electron beam moves from a center of the screen to a peripheral portion of the screen.

5. A tube according to claim 4, wherein a horizontal lens action of the entire main electron lens portion substantially does not change with an increase deflection amount of the electron beam.

6. A tube according to claim 4, wherein the substantially increasing voltage distribution applied to the plurality of electrode structures and the relative arrangement of said electrode structures causes there to be formed first, second, and third lens regions between respective electrode structures, the second lens region being the asymmetrical lens, and wherein the lens actions of the first and third lens regions of the main electron lens portion weaken the focusing forces in the horizontal and vertical directions with an increase in deflection amount of the electron beam, and the asymmetrical lens is formed in the second lens region and acts to have a horizontal component of divergent action and a vertical component of focusing action when the electron beam is not deflected and focuses on the center of the screen, and acts to have a horizontal component of focusing action and a vertical component of divergent action when the electron beam is deflected and focuses on the peripheral portion of the screen.

7. A cathode ray tube comprising:

an electron gun assembly having an electron beam forming portion for forming and emitting at least one electron beam and a main electron lens portion for accelerating and focusing the at least one electron beam; and a deflection yoke for generating a deflecting magnetic field for deflecting the at least one electron beam emitted by said electron gun assembly and scanning a screen in vertical and horizontal directions, the main electron lens portion having a plurality of electrode structures arranged in a traveling direction of the at least one electron beam, wherein a substantially increasing voltage distribution is applied to the plurality of electrode structures, including first and second dynamic voltages applied to respective electrode structures of said plurality of electrode structures, the relative arrangement of said plurality of electrode structures and the application of the substantially continuously increasing voltage distribution thereon causing there to be formed first, second, and third lens regions between respective electrode structures, wherein the second lens region is an asymmetrical lens between respective electrode structures configured to apply horizontal and vertical focusing forces on the at least one electron beam, the horizontal and vertical focusing forces having respective varying magnitudes;

and wherein the lens actions of the first and third lens regions of the main electron lens portion weaken the focusing forces in the horizontal and vertical directions with an increase in deflection amount of the electron beam, and the asymmetrical lens formed in the second lens region acts to have a horizontal component of focusing action and a vertical component of divergent action with an increase in deflection amount of the electron beam.

8. A cathode ray tube comprising:

an electron gun assembly having an electron beam forming portion for forming and emitting at least one electron beam and a main electron lens portion for accelerating and focusing the at least one electron beam; and a deflection yoke for generating a deflecting magnetic field for deflecting the at least one electron beam emitted by said electron gun assembly and scanning a screen in vertical and horizontal directions, the main electron lens portion having a plurality of electrode structures arranged in a traveling direction of the at least one electron beam, wherein a substantially increasing voltage distribution is applied to the plurality of electrode structures, including first and second dynamic voltages applied to respective electrode structures of said plurality of electrode structures, the relative arrangement of said plurality of electrode structures and the application of the substantially continuously increasing voltage distribution thereon causing there to be formed an asymmetrical lens between respective electrode structures configured to apply horizontal and vertical focusing forces on the at least one electron beam, the horizontal and vertical focusing forces having respective varying magnitudes;

wherein the main electron lens portion comprises a plurality of electrodes including an electrode receiving a first-level voltage, an electrode receiving a second-level voltage higher than the first level, and at least two intermediate electrodes which are arranged between the two electrodes and receive voltages in substantially the same level between the first and second levels, and the asymmetrical lens is formed between the two intermediate electrodes, and wherein a lens action of the asymmetrical lens formed between the two intermediate electrodes changes in synchronism with the deflecting magnetic field.

9. A cathode ray tube comprising:

an electron gun assembly having an electron beam forming portion for forming and emitting at least one electron beam and a main electron lens portion for accelerating and focusing the electron beam; and a deflection yoke for generating a deflecting magnetic field for deflecting the electron beam emitted by said electron gun assembly and scanning a screen in vertical and horizontal directions, the main electron lens portion having first, second, and third lens regions arranged in the traveling direction of the electron beam, said lens regions being sequentially formed by a voltage distribution continuously increasing along a traveling direction of the electron beam, the second lens region having means for, assuming that horizontal and vertical directions be perpendicular to the traveling direction of a nondeflected electron beam traveling toward a center of a screen, forming an asymmetrical lens having a focusing force in the vertical direction relatively different from a focusing force in the horizontal direction, wherein a lens action of the main electron lens portion including the asymmetrical lens changes in synchronism with the deflecting magnetic field, and the asymmetrical lens acts to have a horizontal component of focusing action and a vertical component of divergent action, as a deflection amount of the electron beam is increased by the deflecting magnetic field so that the electron beam moves from the center of the screen to a peripheral portion of the screen;

wherein the lens actions of the first and third lens regions of the main electron lens portion weaken the focusing forces in the horizontal and vertical directions with an increase in deflection amount of the electron beam, and the asymmetrical lens formed in the second lens region acts to have a horizontal component of divergent action and a vertical component of focusing action when the electron beam is not deflected and focuses on a center of the screen, and acts to have a horizontal component of focusing action and a vertical component of divergent action when the electron beam is deflected and focuses on a peripheral portion of the screen;

wherein the main electron lens portion comprises a first grid receiving a first-level voltage, a fourth grid receiving a second-level voltage higher than the first level, and at least second and third grids which are arranged between the first and fourth grids along the traveling direction of the electron beam so as to be adjacent to each other and receive voltages in substantially the same level between the first and second levels, the first lens region is formed between the first and second grids, the second lens region including the asymmetrical lens is formed between the second and third grids, and the third lens region is formed between the third and fourth grids, and when the electron beam is not deflected, the voltage applied to the second grid is set lower than the voltage applied to the third grid, and when the electron beam is deflected the voltage applied to the second grid is set higher than the voltage applied to the third grid.

10. A tube according to claim 9, wherein the second grid receives a voltage superposed with an parabolic voltage so as to change the lens action of the asymmetrical lens in synchronism with the deflecting magnetic field.

11. A cathode ray tube comprising:

an electron gun assembly having an electron beam forming portion for forming and emitting at least one electron beam and a main electron lens portion for accelerating and focusing the electron beam; and a deflection yoke for generating a deflecting magnetic field for deflecting the electron beam emitted by said electron gun assembly and scanning a screen in vertical and horizontal directions, the main electron lens portion having first, second, and third lens regions arranged in the traveling direction of the electron beam, said lens regions being sequentially formed by a voltage distribution continuously increasing along a traveling direction of the electron beam, the second lens region having means for, assuming that horizontal and vertical directions be perpendicular to the traveling direction of a nondeflected electron beam traveling toward a center of a screen, forming an asymmetrical lens having a focusing force in the vertical direction relatively different from a focusing force in the horizontal direction, wherein a lens action of the main electron lens portion including the asymmetrical lens changes in synchronism with the deflecting magnetic field, and the asymmetrical lens acts to have a horizontal component of focusing action and a vertical component of divergent action, as a deflection amount of the electron beam is increased by the deflecting magnetic field so that the electron beam moves from the center of the screen to a peripheral portion of the screen;

wherein the lens actions of the first and third lens regions of the main electron lens portion weaken the focusing forces in the horizontal and vertical directions with an increase in deflection amount of the electron beam, and the asymmetrical lens formed in the second lens region acts to have a horizontal component of divergent action and a vertical component of focusing action when the electron beam is not deflected and focuses on a center of the screen, and acts to have a horizontal component of focusing action and a vertical component of divergent action when the electron beam is deflected and focuses on a peripheral portion of the screen;

wherein the main electron lens portion comprises a first grid receiving a first-level voltage, a fourth grid receiving a second-level voltage higher than the first level, and at least second and third grids which are arranged between the first and fourth grids along the traveling direction of the electron beam so as to be adjacent to each other and receive voltages in substantially the same level between the first and second levels, the first lens region is formed between the first and second grids, the second lens region including the asymmetrical lens is formed between the second and third grids, and the third lens region is formed between the third and fourth grids, and when the electron beam is not deflected, the voltage applied to the second grid is set higher than the voltage applied to the third grid, and when the electron beam is deflected the voltage applied to the second grid is set lower than the voltage applied to the third grid.

12. A cathode ray tube comprising:

an electron gun assembly having an electron beam forming portion for forming and emitting at least one electron beam and a main electron lens portion for accelerating and focusing the electron beam; and a deflection yoke for generating a deflecting magnetic field for deflecting the electron beam emitted by said electron gun assembly and scanning a screen in vertical and horizontal directions, the main electron lens portion having first, second, and third lens regions arranged in the traveling direction of the electron beam, said lens regions being sequentially formed by a voltage distribution continuously increasing along a traveling direction of the electron beam, the second lens region having means for, assuming that horizontal and vertical directions be perpendicular to the traveling direction of a nondeflected electron beam traveling toward a center of a screen, forming an asymmetrical lens having a focusing force in the vertical direction relatively different from a focusing force in the horizontal direction, wherein a lens action of the main electron lens portion including the asymmetrical lens changes in synchronism with the deflecting magnetic field, and the asymmetrical lens acts to have a horizontal component of focusing action and a vertical component of divergent action, as a deflection amount of the electron beam is increased by the deflecting magnetic field so that the electron beam moves from the center of the screen to a peripheral portion of the screen;

wherein the lens actions of the first and third lens regions of the main electron lens portion weaken the focusing forces in the horizontal and vertical directions with an increase in deflection amount of the electron beam, and the asymmetrical lens formed in the second lens region acts to have a horizontal component of divergent action and a vertical component of focusing action when the electron beam is not deflected and focuses on a center of the screen, and acts to have a horizontal component of focusing action and a vertical component of divergent action when the electron beam is deflected and focuses on a peripheral portion of the screen;

wherein the main electron lens portion is constituted by sequentially arranging, in the traveling direction of the electron beam, a first grid receiving a first-level voltage, a second grid receiving a second-level voltage higher than the first level, a third grid receiving a third-level voltage higher than the first and second levels, and a fourth grid receiving a fourth-level voltage higher than the first to third grids when the electron beam is not deflected, the first lens region is formed between the first and second grids by a voltage difference between the first and second levels, the second lens region including the asymmetrical lens is formed between the second and third grids by a voltage difference between the second and third levels, and the third lens region is formed between the third and fourth grids by a voltage difference between the third and fourth levels, and the second grid receives a voltage obtained by superposing, on the second-level voltage, a voltage parabolically changing with an increase in deflection amount of the electron beam so as to set the voltage applied to the second grid lower than the voltage applied to the third grid when the electron beam is not deflected, and to set the voltage applied to the second grid higher than the voltage applied to the third grid when the electron beam is deflected.

13. A cathode ray tube comprising:

an electron gun assembly having an electron beam forming portion for forming and emitting at least one electron beam and a main electron lens portion for accelerating and focusing the electron beam; and a deflection yoke for generating a deflecting magnetic field for deflecting the electron beam emitted by said electron gun assembly and scanning a screen in vertical and horizontal directions, the main electron lens portion having first, second, and third lens regions arranged in the traveling direction of the electron beam, said lens regions being sequentially formed by a voltage distribution continuously increasing along a traveling direction of the electron beam, the second lens region having means for, assuming that horizontal and vertical directions be perpendicular to the traveling direction of a nondeflected electron beam traveling toward a center of a screen, forming an asymmetrical lens having a focusing force in the vertical direction relatively different from a focusing force in the horizontal direction, wherein a lens action of the main electron lens portion including the asymmetrical lens changes in synchronism with the deflecting magnetic field, and the asymmetrical lens acts to have a horizontal component of focusing action and a vertical component of divergent action, as a deflection amount of the electron beam is increased by the deflecting magnetic field so that the electron beam moves from the center of the screen to a peripheral portion of the screen;

wherein the lens actions of the first and third lens regions of the main electron lens portion weaken the focusing forces in the horizontal and vertical directions with an increase in deflection amount of the electron beam, and the asymmetrical lens formed in the second lens region acts to have a horizontal component of divergent action and a vertical component of focusing action when the electron beam is not deflected and focuses on a center of the screen, and acts to have a horizontal component of focusing action and a vertical component of divergent action when the electron beam is deflected and focuses on a peripheral portion of the screen;

wherein the main electron lens portion is constituted by sequentially arranging, in the traveling direction of the electron beam, a first grid receiving a first-level voltage, a second grid receiving a second-level voltage higher than the first level, a third grid receiving a third-level voltage higher than the first and second levels, and a fourth grid receiving a fourth-level voltage higher than the first to third grids when the electron beam is not deflected, the first lens region is formed between the first and second grids by a voltage difference between the first and second levels, the second lens region including the asymmetrical lens is formed between the second and third grids by a voltage difference between the second and third levels, and the third lens region is formed between the third and fourth grids by a voltage difference between the third and fourth levels, and the second grid receives a voltage obtained by superposing, on the second-level voltage, a voltage parabolically changing with an increase in deflection amount of the electron beam so as to set the voltage applied to the second grid higher than the voltage applied to the third grid when the electron beam is not deflected, and to set the voltage applied to the second grid lower than the voltage applied to the third grid when the electron beam is deflected.

14. A cathode ray tube comprising:

an electron gun assembly having an electron beam forming portion for forming and emitting at least one electron beam and a main electron lens portion for accelerating and focusing the electron beam; and a deflection yoke for generating a deflecting magnetic field for deflecting the electron beam emitted by said electron gun assembly and scanning a screen in vertical and horizontal directions, wherein the main electron lens portion is a large diameter lens formed by a voltage distribution substantially continuously increasing along a traveling direction of the electron beam on an axis of the main electron lens portion, a middle portion of said main electron lens portion has means for, assuming that horizontal and vertical directions are perpendicular to the traveling direction of a non-deflected electron beam traveling toward a center of a screen, forming an asymmetrical lens providing each of said at least one electron beam with different focusing forces between the horizontal and vertical directions, the power of the main electron lens portion changes in synchronism with the deflecting magnetic field, and the power of the asymmetrical lens changes in synchronism with the deflecting magnetic field.

15. A cathode ray tube comprising:

an electron gun assembly;

a deflection yoke;

a screen;

said electron gun assembly including at least one cathode for forming a respective at least one electron beam and a series of electrode grids;

each of said electrode grids including at least one electrode, said series of electrode grids being consecutively aligned in a traveling direction of the at least one electron beam and being positioned in spaced relation to each other and receiving a continuously increasing voltage distribution along the traveling direction, wherein an intermediate pair of said series of electrode grids and the voltage distribution applied thereto forms an asymmetrical lens therebetween, said asymmetrical lens being configured to apply horizontal and vertical focusing forces to the at least one electron beam, wherein the horizontal and vertical focusing forces have respective varying magnitudes such that said asymmetrical lens is capable of substantially narrowing the at least one electron beam in the horizontal direction and substantially stretching the at least one electron beam in the vertical direction.

* * * * *